US006070569A

United States Patent [19]

Chalin et al.

[11] Patent Number: 6,070,569

[45] Date of Patent: Jun. 6, 2000

[54] BOW ARM SUPPORT STABILIZER SYSTEM

[76] Inventors: Manuel L. Chalin, 64 Evergreen Dr., Kincheloe, Mich. 49788; Philip J. Chalin, 390 E. 11 Mile Rd., Sault Ste. Marie, Mich. 49783

[21] Appl. No.: 09/245,311

[22] Filed: Feb. 5, 1999

Related U.S. Application Data

[60] Provisional application No. 60/073,788, Feb. 5, 1998.

[51] Int. Cl.[7] ..... F41B 5/14; F41B 5/20

[52] U.S. Cl. ..... 124/86; 124/88; 124/89

[58] Field of Search ..... 124/23.1, 86, 88, 124/89

[56] References Cited

U.S. PATENT DOCUMENTS

| | | | |
|---|---|---|---|
| 3,256,872 | 6/1966 | Koser | 124/23.1 |
| 3,502,062 | 3/1970 | Shurts | 124/23.1 |
| 4,360,179 | 11/1982 | Roberts | 248/126 |
| 4,393,614 | 7/1983 | Pickett | 42/94 |
| 4,615,326 | 10/1986 | Rathbun | 124/88 |
| 4,674,472 | 6/1987 | Reis | 124/89 |
| 4,846,140 | 7/1989 | DiMartino | 124/86 X |
| 4,993,398 | 2/1991 | Wallace | 124/23.1 |
| 5,106,044 | 4/1992 | Regard et al. | 248/169 |
| 5,320,085 | 6/1994 | Hanneman | 124/89 |
| 5,345,706 | 9/1994 | Brown | 42/94 |
| 5,509,400 | 4/1996 | Chalin | 124/86 |
| 5,619,981 | 4/1997 | Breedlove | 124/89 |

*Primary Examiner*—John A. Ricci

*Attorney, Agent, or Firm*—Lowe Hauptman Gopstein Gilman & Berner

[57] ABSTRACT

A bow arm support stabilizer system for supporting the weight of the bow while aiming and shooting is disclosed. The system has a horizontal connecting shaft with a rear end attached to the riser section of the bow through a single stud received in the threaded bore conventionally formed in the riser section. A pair of clamping arms attached to the horizontal connecting shaft extend rearwardly to locate clamping jaws respectively adjacent side surfaces of the riser section. The clamping arms are pivoted on the horizontal section to urge the jaws into clamping contact with the riser section. A telescopic support rod assembly is pivotally mounted to the front end of the horizontal shaft. The rod assembly includes at least three rods telescopically connected together with internal locking mechanisms between adjacent rod sections to effectively control the length of the rod assembly by rotation of one rod relative to another in a locking direction or reverse rotation in an unlocking direction. The non-rotational connection prevents relative twisting movement between the bow and the shaft as a result of high torque at these points of connection generated by the movement arm effect of the support arm assembly relative to the ground.

8 Claims, 12 Drawing Sheets

BOW ARM SUPPORT STABILIZER SYSTEM

RELATED APPLICATIONS

The present application claims priority of U.S. Provisional Application Ser. No. 60/073,788, filed Feb. 5, 1998, entitled "Improvements to Bow Arm Support Stabilizer System", the disclosure of which is incorporated by reference herein in its entirety.

TECHNICAL FIELD

The present invention relates generally to archery and, more particularly, to a stabilizing system for supporting a bow during aiming and shooting so that the weight of the bow is not borne solely by the extended bow arm of the archer.

BACKGROUND ART

In prior U.S. Pat. No. 5,509,400 to Manuel L. Chalin, there is disclosed a bow arm support stabilizer system in which a telescopic support rod assembly is pivotally mounted to the front end of a horizontal shaft projecting forwardly and connected to the riser section of an archer's bow. The lower end of the support rod assembly is provided with a rubber cap adapted to frictionally engage the top of the archer's shoe to support the bow through the support rod assembly and the horizontal shaft. The non-rotational connection prevents relative twisting movement between the bow and the shaft as a result of high torque at these points of connection generated by the moment arm effect of the support rod assembly relative to the ground.

While the stabilizer system disclosed in the '400 patent is effective, it also requires a keyed connection between the horizontal shaft and the bow riser section to prevent the twisting movement from occurring. This necessitates the drilling of an additional hole in a conventional riser section which many archers are reluctant to do in order to utilize that invention.

It is accordingly one object of the present invention to minimize quivering of an archer's extended bow arm while aiming and shooting to improve accuracy of the shot.

Another object is to provide a new mechanism which is easily attachable to an archery bow without requiring tools and a support assembly for the mechanism which is adjustable to engage a supporting surface to support the weight of the bow while aiming and shooting.

Yet a further object is to provide a new mechanism that does not require any retrofitting of conventional bows to facilitate mounting of the new stabilizing and bow supporting equipment.

DISCLOSURE OF THE INVENTION

A bow arm support stabilizer system for supporting an archer's bow relative to a support point external to the archer, in accordance with the present invention, comprises a bow connecting arm assembly connected to project forwardly from a riser of the bow, and a support rod assembly connected to project downwardly from the bow connecting arm assembly so that a lower end of the support rod assembly is engageable with the external support point. The connecting arm assembly and support rod assembly cooperate with each other to transfer the weight of the bow to the external support point so that the archer's extended bow arm does not have to support the bow's weight during aiming and shooting. This greatly reduces quivering of the archer's arm to improve accuracy in shooting.

In accordance with the preferred embodiment, the bow connecting arm assembly preferably includes a connecting shaft secured at a rear end thereof to the riser section with a stud projecting from a conventional threaded bore in the riser section for reception in the rear end. A pair of clamping arms respectively secured to the connecting shaft in a pivotal manner are further respectively formed with clamping jaws extending laterally adjacent the side surfaces of the bow riser section. These clamping jaws can be pivoted into tight clamping contact with the riser section to prevent relative rotation between the shaft and the riser section.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF DRAWINGS

FIG. 5D is an enlarged sectional view of the clamping jaw design according to the preferred embodiment;

BEST MODE FOR CARRYING OUT THE INVENTION

Figure 1:
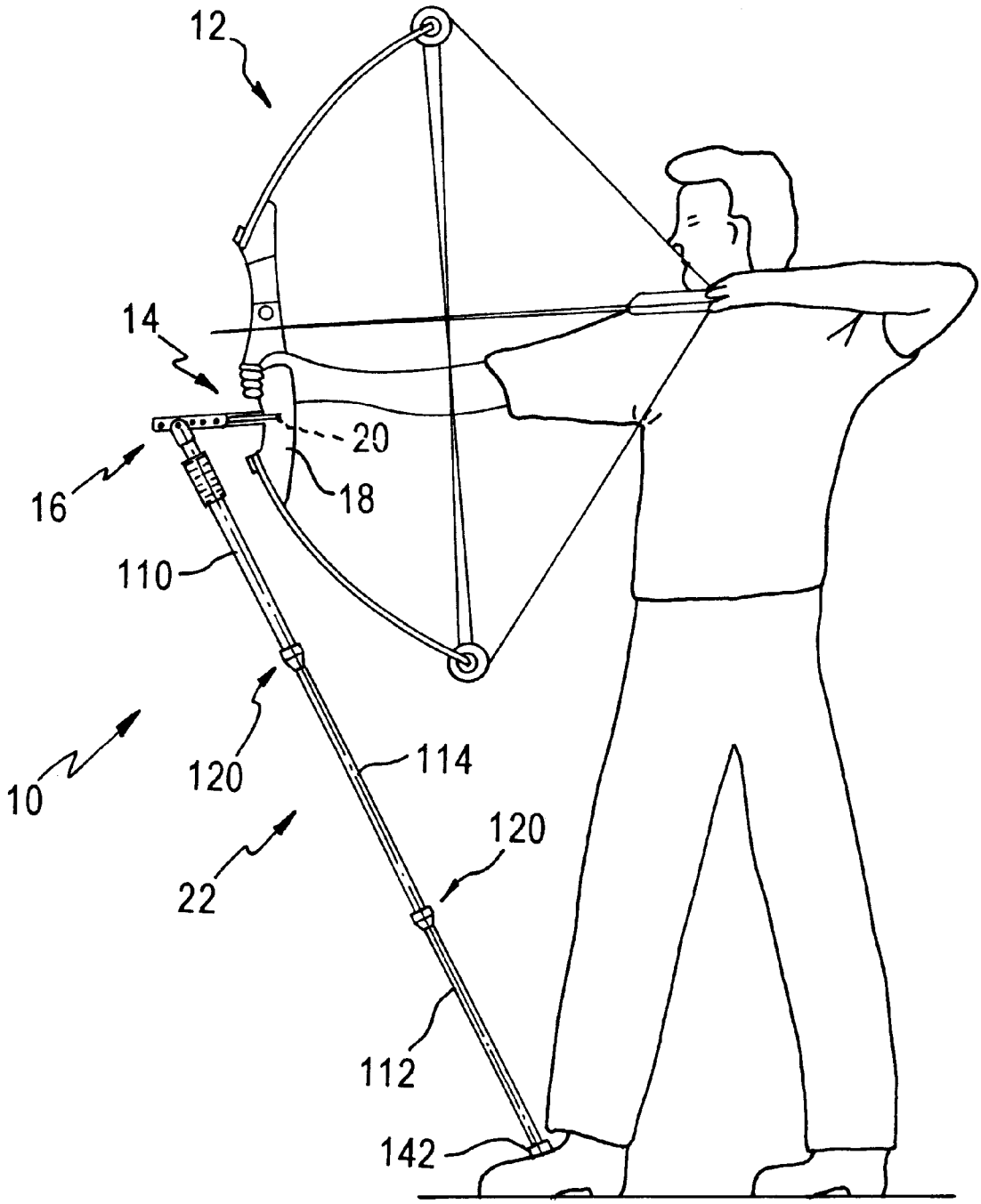
FIG. 1 is a perspective view of the bow arm support stabilizer system during operational use while an archer is aiming the bow.

Referring to FIG. 1, the bow arm support system 10 of the present invention is utilized to substantially entirely support the weight of the archer's bow 12 during aiming and shooting. Support system 10 includes a number of improvements over our prior design disclosed in U.S. Pat. No.

5,509,400. For example, system 10 utilizes a unique clamping mechanism 14 which cooperates with the threaded bore or stabilizer port 20 that is customarily found in manufactured compound bows to receive stabilizers, etc., to securely and non-rotatably connect the bow connecting arm assembly 16 to the riser section 18 of the bow 12, advantageously without requiring the user to modify the riser section to create a keyway as occurred in our prior design. The system 10 also features a three part telescopic pole assembly 22 utilizing a unique internal locking mechanism that ensures positive locking retention of the pole sections at any infinitely variable height. The various components described hereinbelow have been redesigned to reduce machining costs. Other unique features of the invention will be identified as the description proceeds.

Figure 3A:
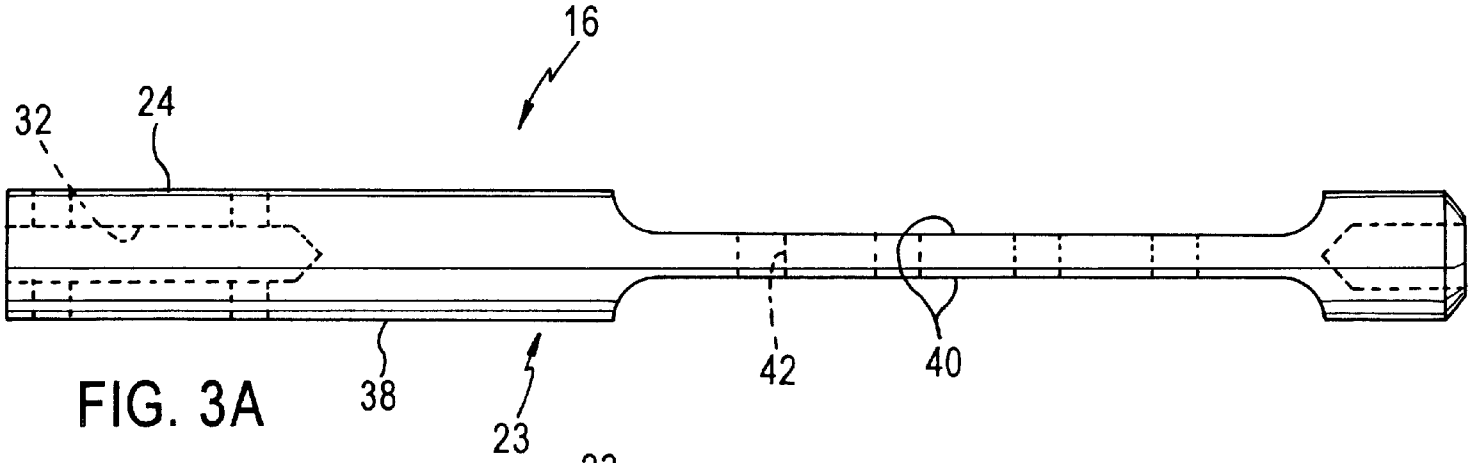
FIG. 3A is a top plan view of the horizontal connecting shaft.
Figure 3B:
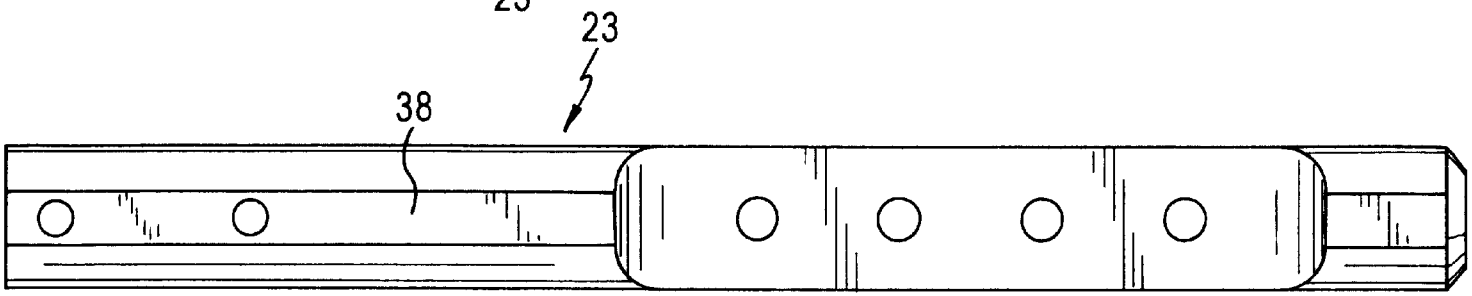
FIG. 3B is a side elevational view of the horizontal connecting shaft.
Figure 3C:
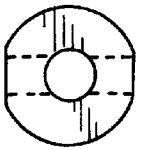
FIG. 3C is a rear end elevational view of the horizontal connecting shaft.
Figure 3D:
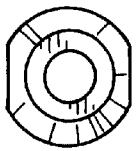
FIG. 3D is a front end elevational view of the horizontal connecting shaft.
Figure 4:
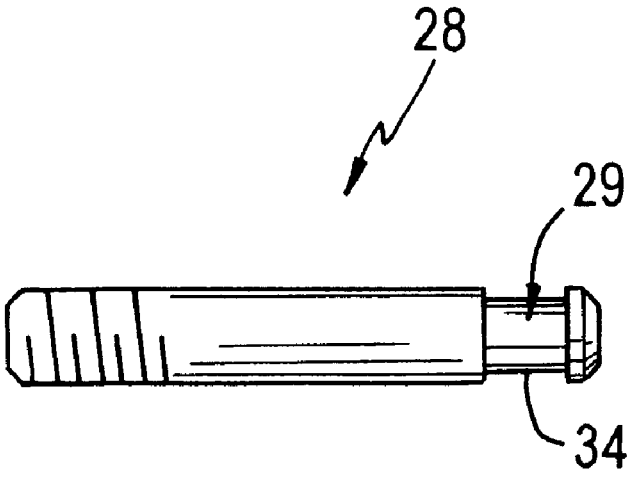
FIG. 4 is a plan view of a bow riser section connection stud.

The bow connecting arm assembly 16 is comprised of a generally horizontally extending rod 23 (see FIGS. 3A and 3B) having a rearwardly extending end 24 connected to the bow riser section 18 through a pair of clamping members 26 (FIGS. 5A and 5B) and a riser stud 28 (FIGS. 4 and 5A,5B) threadedly connected at one end into the stabilizer port 20 of the riser section 18. The forwardly projecting end 29 of the preferably cylindrical stud 28 is received in an axial bore 32 formed in the rear end 24 of the connecting rod 23 to positively orient the connecting arm assembly in proper location on the bow 12 (FIG. 1). The forward end 29 of the riser stud 28 may be formed with an annular recess 34 adapted to positively capture a pair of clamping arm tightening screws 36 that extend into the bore 32 as described hereinbelow.

Figure 6:
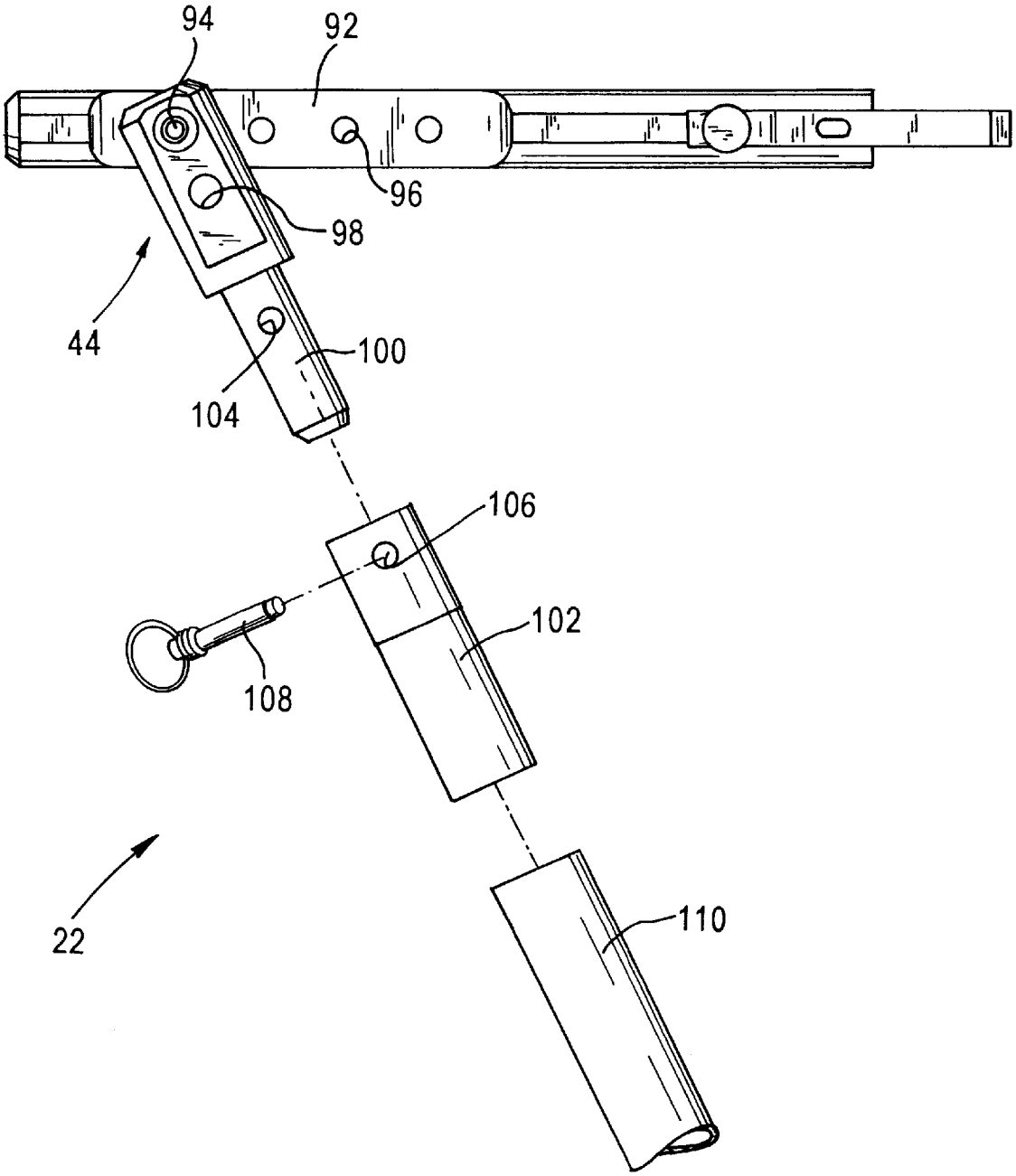
FIG. 6 is a side elevational view of a pivot connection between the connecting shaft and the support rod assembly.

The connecting rod 23 is preferably formed from a length of stainless steel cylindrical stock (e.g. 7.75 inches in length) in which the rearwardly extending cylindrical portion is formed with a pair of parallel machined flat surfaces 38 to which the clamping arms 26 are connected to the assembly. The forwardly extending portion of the rod 23 is formed with a pair of machined cutouts 40 defining a pair of parallel side walls through which a series of horizontally spaced unthreaded through bores 42 extend. As depicted in FIG. 6, this section 40 of the connecting rod 23 is adapted to be cradled within the upper end of a mounting fork 44 through which the connecting rod 23 is pivotably secured to the generally vertically extending bow arm support rod 22 described infra.

Figure 5C:
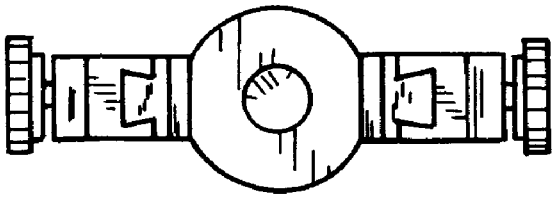
FIG. 5C is a rear end elevational view of the connection assembly of FIG. 5A with the riser removed.
Figures 5A, 5B:
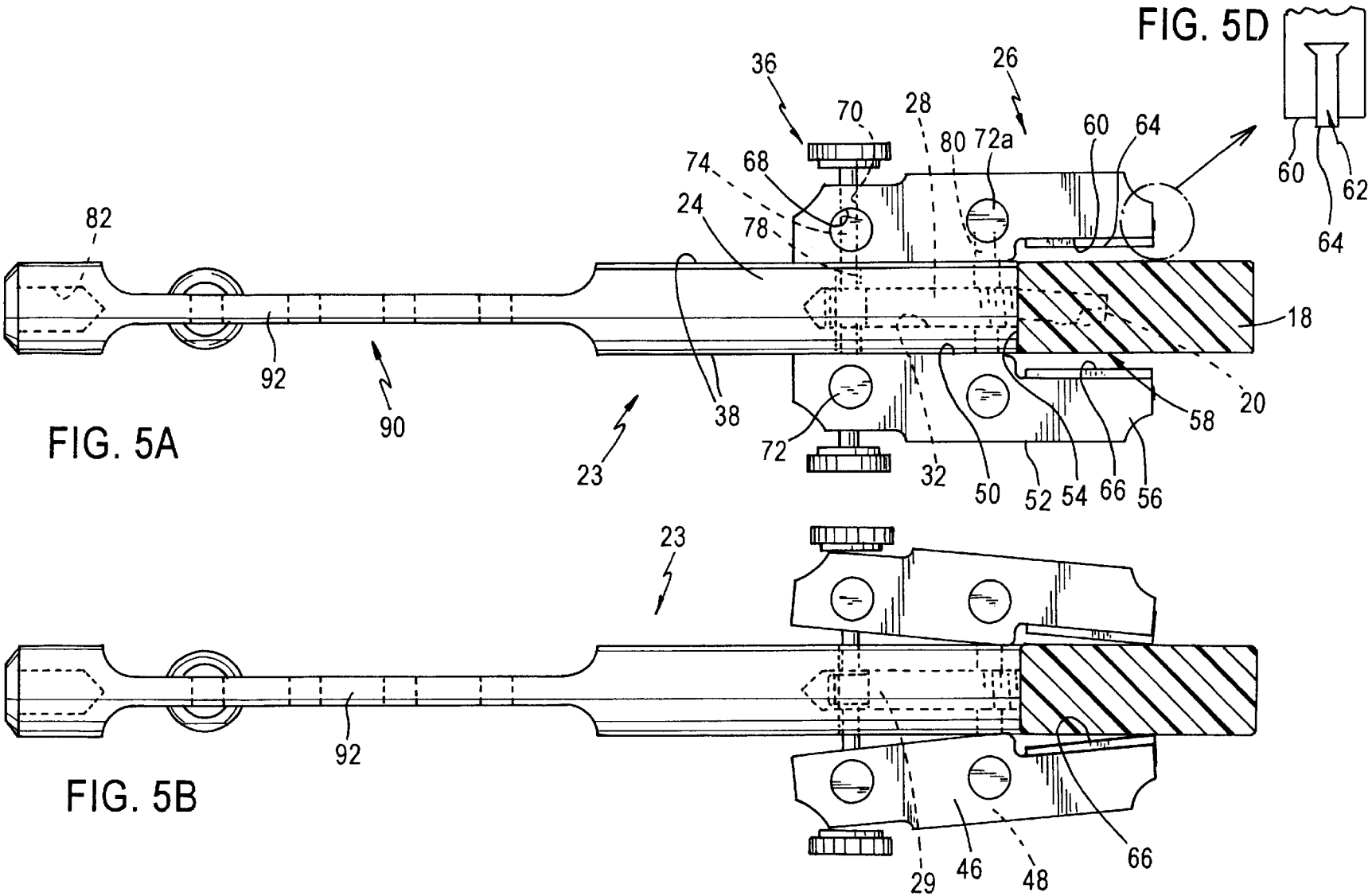
FIG. 5A is a top plan view of the bow arm connection assembly in an unclamped position.
FIG. 5B is a view similar to FIG. 5A in which the clamping jaws are in the clamped position.

Each of the two clamping arms 26 (FIGS. 5A and 5B) is preferably formed from a piece of rectangular stainless steel stock and therefore has parallel top and bottom horizontal surfaces 46,48 and parallel inner and outer vertical sides 50 and 52 extending in the longitudinal direction. The forwardly extending portion of the inner side 50 is adapted to abut against the machined flats 38 of connecting rod 23 and terminates at the rear end 24 of the connecting rod. This rear end 24 is adapted to firmly abut against the forward edge 54 of the riser section 18 surrounding the stabilizer bore 20. Optionally, however, a synthetic washer (e.g., a nylon washer of approximately 0.03 inch thickness) may be mounted between rear end 24 and forward edge 54 to prevent the bow from becoming marred. The rearwardly extending portion 56 of each clamping arm 26 inner side is formed with a profiled cutout 58 to define a pair of rearwardly extending parallel vertical surfaces 60 which are adapted to straddle the opposite sides of the bow riser section 18 when the connecting rod 23 is mounted to the riser stud 28. Each of the vertical surfaces 60 is formed with an elongate horizontally extending dove tailed groove 62 (see FIG. 5D) into which is slid a correspondingly shaped clamping insert 64 preferably made of ultra high polyethylene. It is desirable to manufacture the inserts 64 out of plastic in order to compensate for the varying shapes of bow risers while providing a material that is sufficiently firm to perform the clamping function while being somewhat resilient to compensate for such varying shapes. Each of the inserts 64 has a correspondingly shaped dove tail outer section that is slid into the rear opening of the dove tail groove 62. The inner section of each insert 64 is a vertically extending flat surface 66 adapted to clamp against the bow riser section 18 (FIG. 5B).

The forwardly extending portion of each clamping arm 26 is formed with a pair of horizontally spaced vertical through bores 68 intersected respectively with a horizontally extending through bore 70 communicating with the vertical sides of the clamp. A brass cross dowel 72 of generally cylindrical shape is mounted within each vertical through bore 68 and is formed with a threaded through bore 74 in coaxial alignment with the associated horizontal bore 70 extending transversely through the clamping arm. A screw 36 is threadedly received in each of the forward pair of cylindrical dowel sections 72 and projects inwardly into threaded engagement with a tapped bore 78 intersecting the axial bore 32 at right angles. The inwardly extending ends of these attachment screws 36 may project transversely into the axial bore 32 to be tightened against the portion of the riser stud 28 extending forwardly of the bow riser section into the connecting rod 23.

The rearwardly located dowels 72*a* each have a vertical axis of rotation that functions as a pivot axis about which the clamping sections 26 pivot under the action of clamp tightening screws 36 respectively extending through the front cylindrical dowels 72. To function as a pivot, each rear dowel 72*a* is interconnected to a rearward portion of connecting rod end 24 with a threaded member 80 threadedly attached at one end thereof to one of dowels 72*a* and having an inwardly extending portion in threaded engagement with connecting rod rear end 24. Preferably, the horizontally extending through bore intersecting each rear dowel 72*a* is formed as an elongated slot (in the longitudinal direction of the clamping arm 26) so that members 80 can freely move within their respective elongated slot as the clamping arms are pivoted from the unclamped position of FIG. 5A into the clamped position of FIG. 5B. During this pivoting movement, it will be appreciated that rear dowels 72*a* rotate within their vertical through bore as the clamping arms 26 pivot.

The forwardmost end of connecting rod 23 may also be formed with a threaded bore 82 which may be optionally used by a bow hunter to attach either a string tracker, bow fishing pole, or stabilizers.

Figure 2:
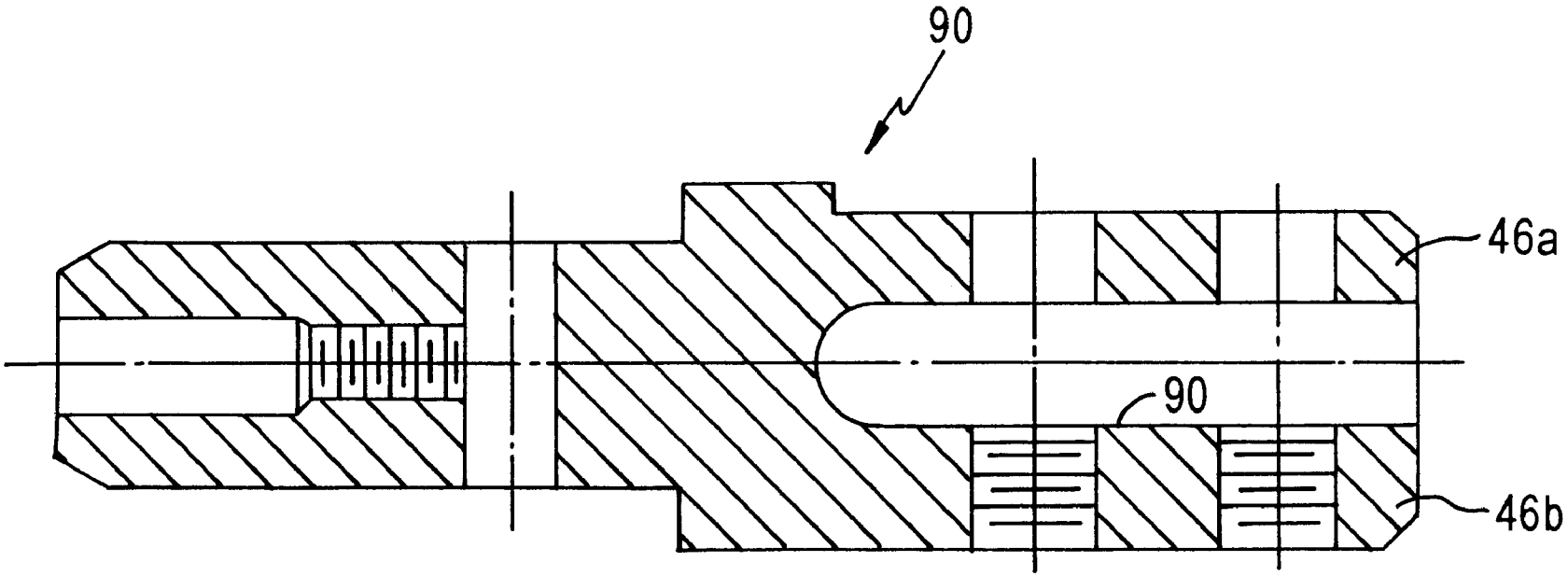
FIG. 2 is a top plan view of a mounting fork used to connect the connecting shaft to a support rod assembly.

The telescopic pole assembly 22 is connected to the bow connecting arm assembly 16 through the mounting fork 44 best depicted in FIGS. 2 and 6. Mounting fork 44 includes a pair of fork arms 46*a* and 46*b* defining an upwardly directed recess 90 adapted to receive the forwardly extended narrow section 92 for clamping between the fork arms with a screw 94. By providing a plurality of through bores 96 in the thin section 92 and two vertically spaced through bores 98 in fork 44, there is afforded a multiplicity of vertical lock positions of the telescopic pole assembly 22 relative to connecting rod 23.

Mounting fork 44 further includes a connecting rod section 100 depending downwardly from the base of fork arms 46*a*,46*b* which is adapted to interfit within a hollow mounting sleeve 102 by insertion of the lower end through the sleeve upper end. The connecting rod section 100 and mounting sleeve 102 each respectively include a pair of detent openings 104,106 adapted to respectively receive a detent pin 108 for ease of interlocking the two components to each other. The lower end of mounting sleeve 102 is preferably pressure fit within the upper end of the uppermost pole 110 which is interconnected to the lowermost pole 112 through an intermediate pole 114 as best depicted in FIG. 1.

Figure 7A:
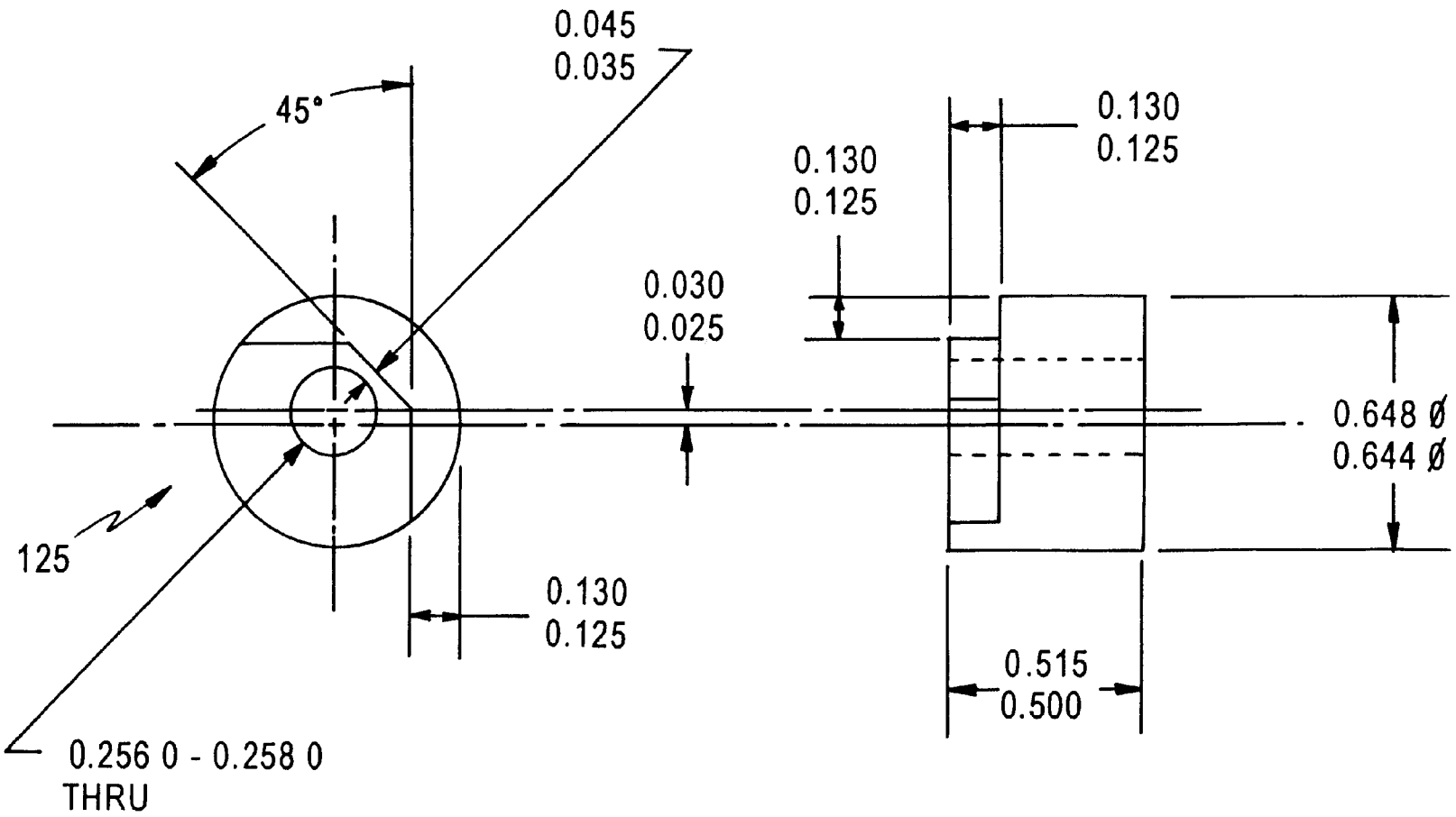
FIGS. 7A–7D are views of top and bottom parts of internal locking mechanisms used to connect the respective poles of the telescopic pole assembly together depicted in FIG. 7E.
Figure 7B:
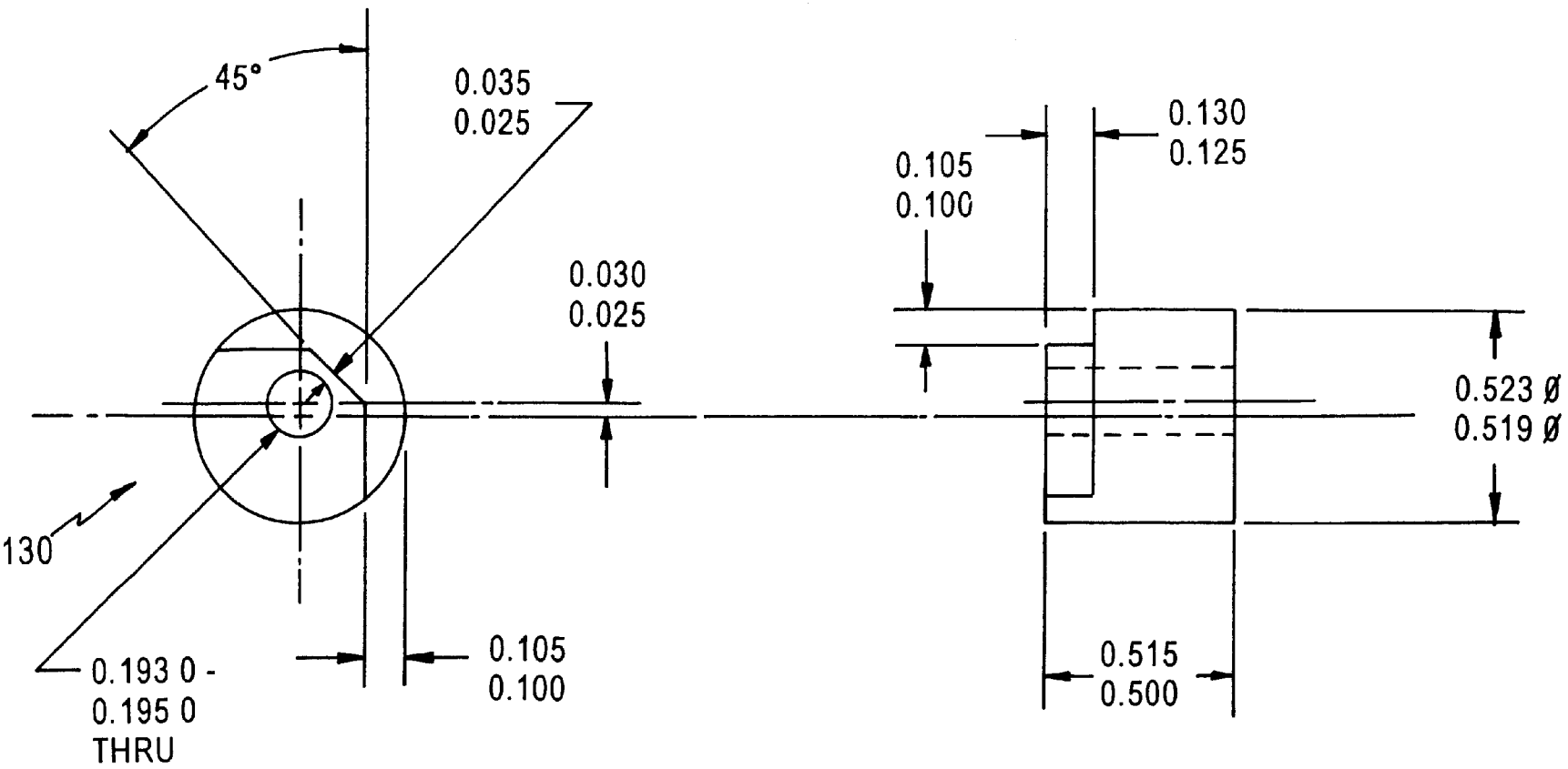
Figure 7C:
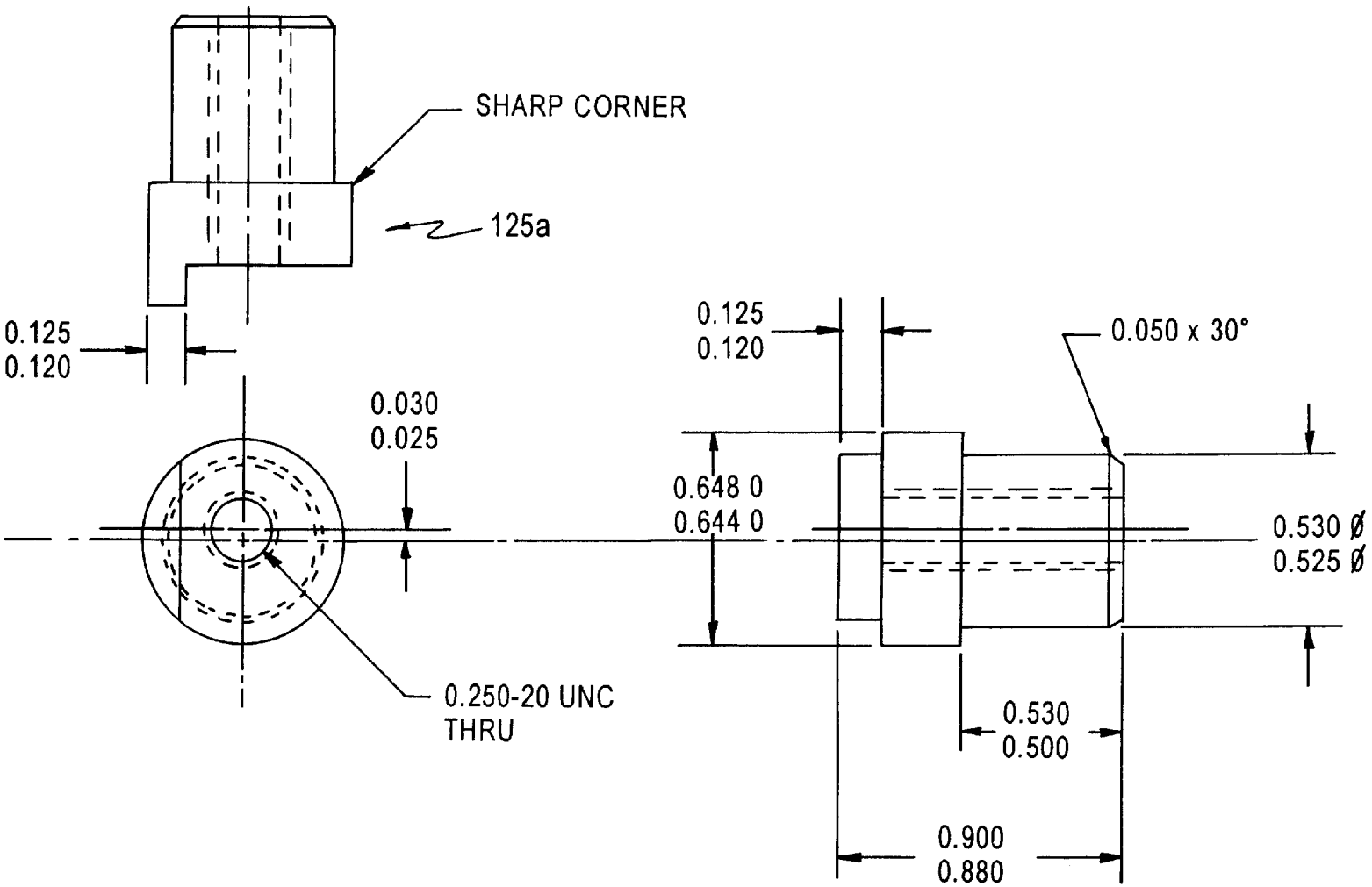
Figure 7D:
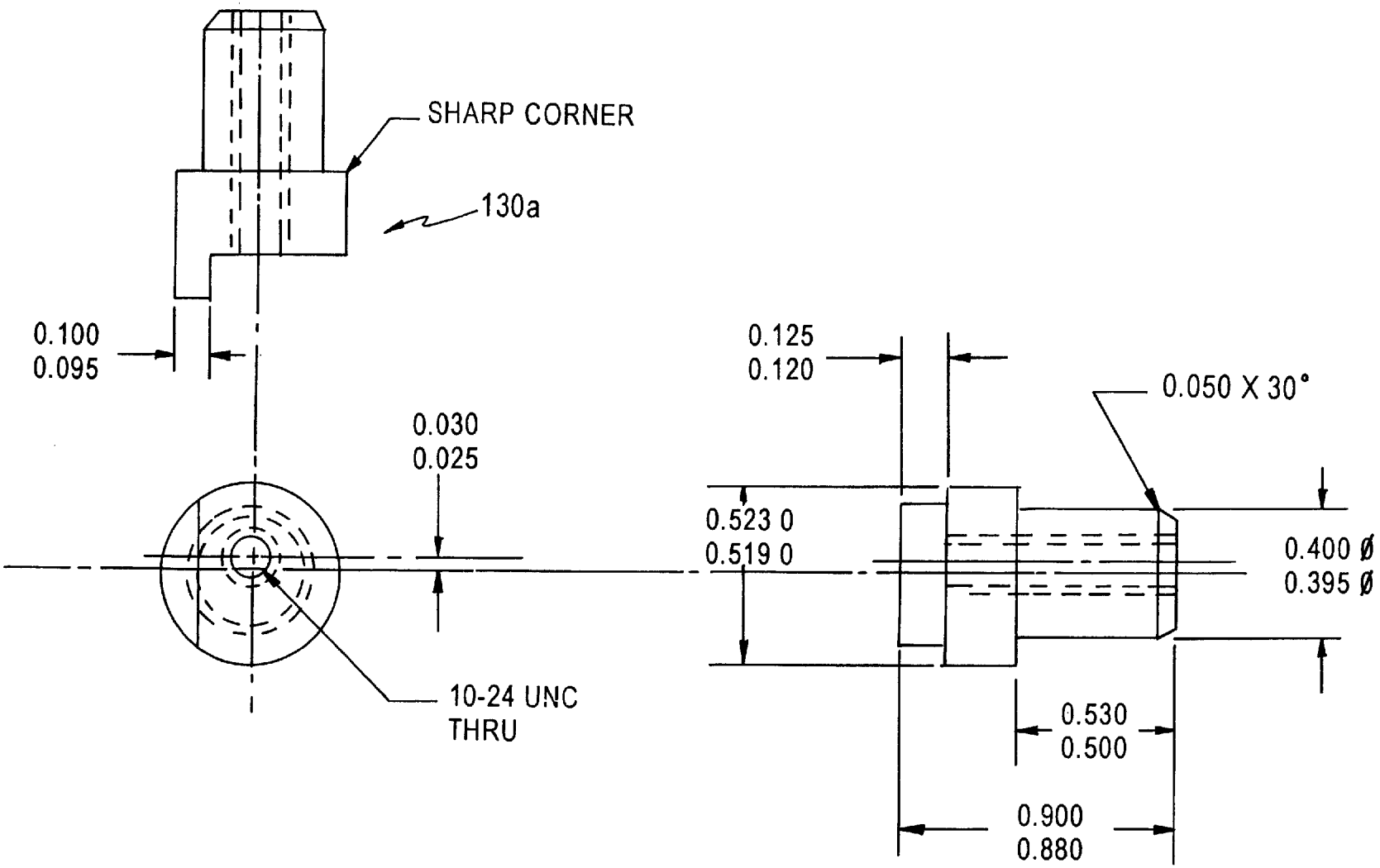
Figure 7E:
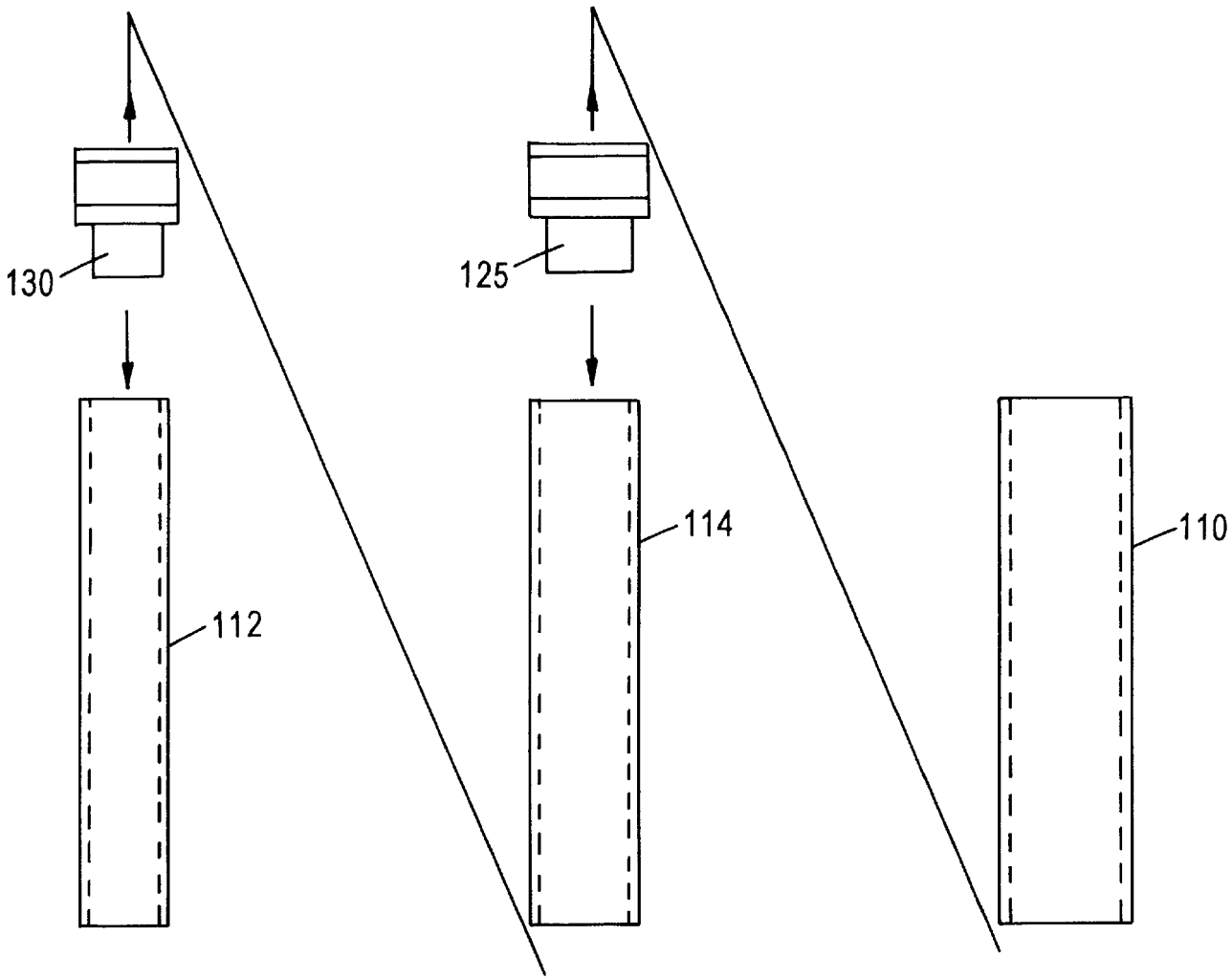

The poles 110,114 are telescopically connected to each other and individually capable of being locked in an extended position through one of a pair of internal locks generally designated with reference numeral 120. More specifically, each internal lock 120 includes a top part and a bottom part. The bottom part 125 depicted in FIG. 7A is received in the upper end of intermediate pole section 114 and is crimped with two to four crimp points for secure retention. The bottom part 130 (FIG. 7B) of the second internal lock 120 is received in the upper end of lowermost pole 112, with crimped connections in the aforesaid manner. The top part 125*a* of the first locking mechanism 120 as depicted in FIG. 7C is connected to the top part 125 with a screw as is the top part 130*a* (see FIG. 7D) connected to the bottom part 130. The tops of each lock are preferably fastened within, for example, 0.003 inch of the associated bottom part. The top is then free to rotate and the screws expand the bottom part of the lock.

The holes in the center of each of the top and bottom locking parts are offset and the lock is designed to lock in one direction and to turn freely in the other direction but may be made to lock in either direction or to lock in both directions.

Although not shown in detail, plastic caps may be utilized to center the telescoping poles 110,114 relative to each other to ensure that the components of each locking mechanism 120 are straight with respect to each other.

Figure 8:
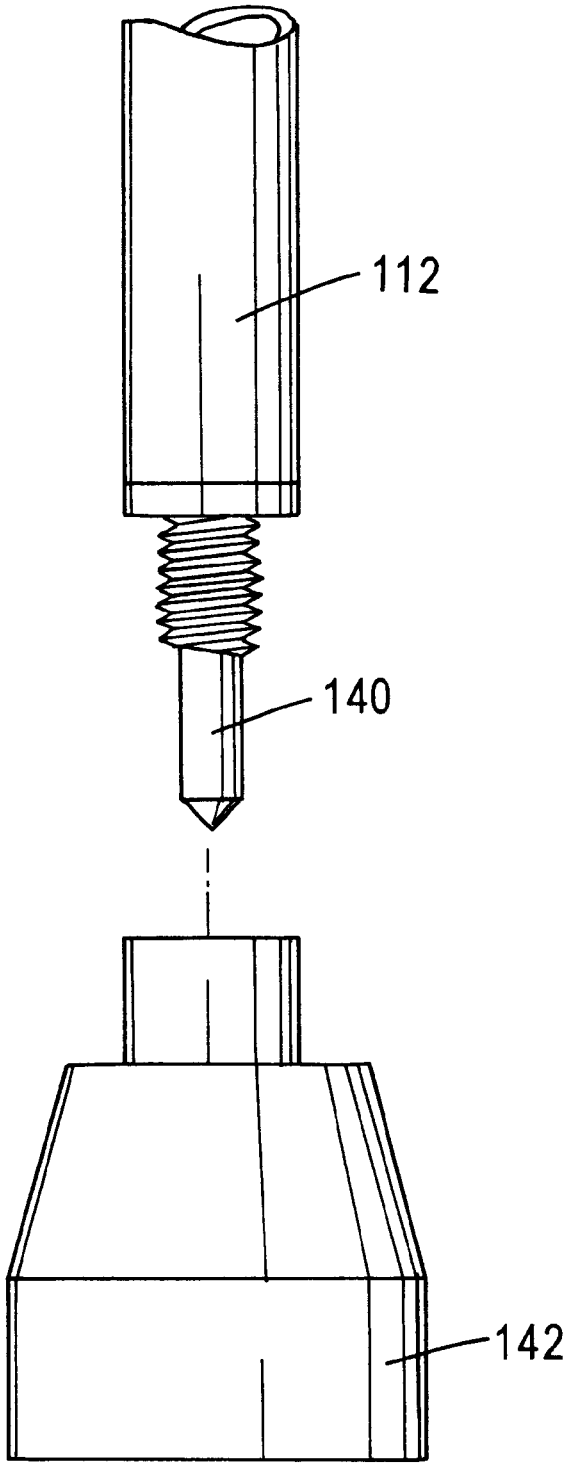
FIG. 8 is a side elevational view of the bottom of the support rod assembly.

The lowermost pole 112 has a probing point 140 that is press fitted into the bottom open end thereof (FIG. 8). The point advantageously enables the telescopic pole assembly 22 to function as a walking stick under icy or rugged condition and also provides a means of checking dead animals at a safe distance. The probing point 140 may be optionally covered with a foot 142 which functions as a point protector and a support point enabling the pole assembly 22 to rest on the archer's foot as depicted in FIG. 1. A metal washer (not shown) is preferably bedded inside the protector and engages portions of the probing point 140 located radially outwardly from the probing point to spread the load being exerted upon the protector 142 by the pole assembly. A metal washer also prevents the point protector from cutting through the rubber protector 142.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A bow arm support stabilizer system in combination with an archer's bow for supporting the archer's bow relative to a support point, comprising:

a) a bow connecting arm assembly non-rotatably connected to project forward from a riser section of the bow, wherein said bow connecting arm assembly includes a connecting shaft having a clamped connection at a rear end thereof to provide for clamped attachment to the riser section; and b) a support rod assembly connected to project downwardly from the bow connecting arm assembly so that a lower end of said support rod assembly is engageable with said support point.

2. The stabilizer system of claim 1, whereby longitudinal axes of said bow, said connecting shaft, and said support rod assembly lie along substantially the same plane, whereby said connecting arm assembly and support rod assembly transfers the weight of the bow to the support point so that the archer's support arm does not have to support the bow's weight during aiming and shooting.

3. The stabilizer system of claim 1, wherein said connecting arm assembly includes a stud connected to project forwardly from a bow riser section for reception in a rear end of said shaft.

4. The bow arm stabilizer system of claim 1, wherein said support rod assembly includes a plurality of rods telescopically connected to each other, and further comprising an internal locking system for locking adjacent rods together, whereby rotation of one rod relative to the adjacent rod in one direction serves to unlock the locking system and rotation in an opposite direction serves to lock the locking system to selectively adjust the effective length of the support rod assembly.

5. A bow arm support stabilizer system in combination with an archer's bow for supporting the archer's bow relative to a support point, comprising:

a) a bow connecting arm assembly non-rotatably connected to project forward from a riser section of the bow, wherein said bow connecting arm assembly includes a connecting shaft having a clamped connection at a rear end thereof to provide for clamped attachment to the riser section; and b) a support rod assembly connected to project downwardly from the bow connecting arm assembly so that a lower end of said support rod assembly is engageable with said support point;

wherein said connecting arm assembly includes a stud connected to project forwardly from the bow riser section for reception in a rear end of said shaft;

wherein said clamped connection includes a pair of clamping members pivotally attached to the shaft at an intermediate section of each clamping member and a clamping screw extending through a forward end of each clamping member and terminating within said shaft, each clamping member including a clamping jaw extending laterally adjacent a side surface of the bow riser section, whereby rotation of said screws causes said jaws to be urged about said pivot into clamping contact with said riser section.

6. A method for supporting an archer's bow during use, comprising the steps of:

a) clamping a bow connecting arm assembly through a pair of flat clamping surfaces thereof to respective flat sides of said bow riser;

b) connecting a support rod assembly to said bow connecting arm assembly so that said rod assembly projects downwardly from the bow to engage a support surface at a lower end thereof; and c) extending the archer's bow arm during aiming and shooting with the weight of the bow being supported by the support rod assembly engaging said support surface.

7. A bow arm support stabilizer system in combination with an archer's bow for supporting the archer's bow relative to a support point, comprising;

a) a bow connecting arm assembly including a connecting shaft and a pair of clamping members extending rearwardly from the connecting shaft, each clamping member having a flat clamping surface, said clamping members being connected to the connecting shaft through a connecting mechanism enabling said clamping surfaces to be moved towards each other into clamping contact with opposing sides of said bow riser; and b) a support rod assembly connected to project downwardly from the bow connecting arm assembly so that a lower end of said support rod assembly is engageable with said support point.

8. The bow arm support stabilizer system of claim 7, further including a stud connected to project rearwardly from a rear end of said connecting shaft for reception in an opening formed in a front facing portion of the bow riser section to provide further connection of said bow connecting arm assembly to said riser section.

* * * * *